US005340997A

United States Patent [19]

Kuo

[11] Patent Number: 5,340,997

[45] Date of Patent: Aug. 23, 1994

[54] ELECTROSTATICALLY SHIELDED FIELD EMISSION MICROELECTRONIC DEVICE

[75] Inventor: Huei-Pei Kuo, Cupertino, Calif.

[73] Assignee: Hewlett-Packard Company, Palo Alto, Calif.

[21] Appl. No.: 124,328

[22] Filed: Sep. 20, 1993

[51] Int. Cl.[5] ..... H01J 1/02

[52] U.S. Cl. ..... 257/10; 257/659; 315/169.1; 315/349; 313/309; 313/336; 313/351

[58] Field of Search ..... 257/10, 659, 660; 315/169.1, 349; 313/309, 336, 351, 352

[56] References Cited

U.S. PATENT DOCUMENTS

| | | | |
|---|---|---|---|
| 4,683,399 | 7/1987 | Soclof | 257/10 |
| 4,908,539 | 3/1990 | Meyer | 315/169.1 |
| 4,987,377 | 1/1991 | Gray et al. | 313/309 |
| 5,012,153 | 4/1991 | Atkinson et al. | 315/169.1 |
| 5,075,595 | 12/1991 | Kane | 313/169 |
| 5,138,237 | 8/1992 | Kane et al. | 315/349 |
| 5,140,219 | 8/1992 | Kane | 313/495 |
| 5,173,534 | 12/1992 | Kane | 315/58 |
| 5,189,341 | 2/1993 | Itoh et al. | 315/169.1 |
| 5,191,217 | 3/1993 | Kane et al. | 315/169.1 |
| 5,196,767 | 3/1993 | Leard et al. | 315/169.1 |
| 5,210,472 | 5/1993 | Casper et al. | 315/169.1 |
| 5,212,426 | 5/1993 | Kane | 315/169.1 |
| 5,245,247 | 9/1993 | Hosogi | 313/309 |

OTHER PUBLICATIONS

Jones et al., "Fabrication of Silicon Point, Wedge, and Trench FEAs", Technical Digest of Int. Vacuum Microelectronics Conf., 1991, pp. 34–35.

Spindt et al., "Physical Properties of Thin-Film Field Emission Cathodes with Molybdenum Cones", Journal of Applied Physics, vol. 47, No. 12, Dec. 1976, pp. 5248–5263.

Pan et al., "Numerical Analysis of Spindt Type Cathode and Two Kinds of Vacuum Microelectronic Devices", Techical Digest of IVMC, 1991.

Gray et al., "A Silicon Field Emitter Array Planar Vacuum Fet Fabricated with Micro Fabrication Techniques", Materials Research Society Symposium Proc., vol. 76, pp. 25–31, 1987.

*Primary Examiner*—Rolf Hille
*Assistant Examiner*—Minhloan Tran
*Attorney, Agent, or Firm*—Peter P. Tong

[57] ABSTRACT

A field emission microelectronic device based on field emitter structures and fabrication processes. In one embodiment, the microelectronic device includes an electron source, a collector adjacent to the source, and an isolator. The source and the collector are both coupled to a substrate. At appropriate voltages on the source and the collector, electrons are emitted from the emitter out of the substrate into the collector per unit time, creating a current. The isolator is at an isolator voltage to create an electrostatic enclosure to substantially confine the electrons in the vicinity of the electron source and the collector. The microelectronic device is substantially electrostatically shielded and may be used as a current controller in a flat panel displays.

19 Claims, 11 Drawing Sheets

ELECTROSTATICALLY SHIELDED FIELD EMISSION MICROELECTRONIC DEVICE

BACKGROUND OF THE INVENTION

The present invention relates generally to microelectronic devices and more particularly to an electrostatically shielded microelectronic devices based on field emitter technologies.

An easy-to-build flat panel display has been considered as the "Holy Grail" in the area of electronics. Numerous researchers have been trying to invent such a display.

One essential element of such a display is transistors or microelectronic devices to control the field emitters. Various transistors have been proposed and implemented, for example, using thin-film techniques to fabricate bipolar transistors and field effect transistors on semiconductor substrates.

Unfortunately, most prior art transistor techniques are usually not compatible with the technologies to fabricate the field emitters. A field emitter usually has a very sharp tip, at zero or negative voltage, positioned in close proximity to a gate at a different voltage to emit electrons. Such structures are quite different to the prior art structures of bipolar and field effect transistors. Thus, field emitters and transistors have to be built by different processes, significantly increasing the complexities in making a flat panel display.

One prior art method tries to use the field emitter approach to build a transistor. That device has an emitter emitting electrons, and a collector at a positive voltage to collect the emitted electrons. However, the device is not electrostatically shielded and is very susceptible to influences from the environment. Operation of field emission depends critically on the trajectories of the electrons. These trajectories, in turn, are influenced by the shapes and electric potentials of their surrounding structures. For example, if the device is positioned under a screen with a positive voltage, as in a flat panel display, the electrons initially going to the collector would be attracted towards the screen, significantly degrading the performance of the device.

It should be apparent from the foregoing that there is still a need for a microelectronic device that is based on similar technologies as field emitters to function in areas, such as flat panel displays.

SUMMARY OF THE INVENTION

The present invention describes a microelectronic device that is based on similar technologies as field emitters.

In one preferred embodiment, the microelectronic device includes an electron source, a collector and an isolator. The electron source may include an electron emitter and a gate. The electron source and the collector are connected to a substrate, with the collector being adjacent to the source.

The electron source is under the control of one or more voltages for the emission of electrons out of the substrate. The collector is at a collector voltage to receive a current, which is substantially proportional to the number of electrons emitted from the source into the collector per unit time.

The isolator is at an isolator voltage to create an electrostatic enclosure substantially confining the electrons in the vicinity of the electron source and the collector.

The preferred embodiment is substantially electrostatically shielded and may be applied to flat panel displays with high voltages in the vicinity of the embodiment.

Other aspects and advantages of the present invention will become apparent from the following detailed description, taken in conjunction with the accompanying drawings, illustrating by way of example the principles of the invention.

Same numerals in FIGS. 1 to 10 are assigned to similar elements in all the figures. Embodiments of the invention are discussed below with reference to FIGS. 1–10. However, those skilled in the art will readily appreciate that the detailed description given herein with respect to these figures is for explanatory purposes as the invention extends beyond these limited embodiments.

DETAILED DESCRIPTION OF THE INVENTION

Figure 1A:
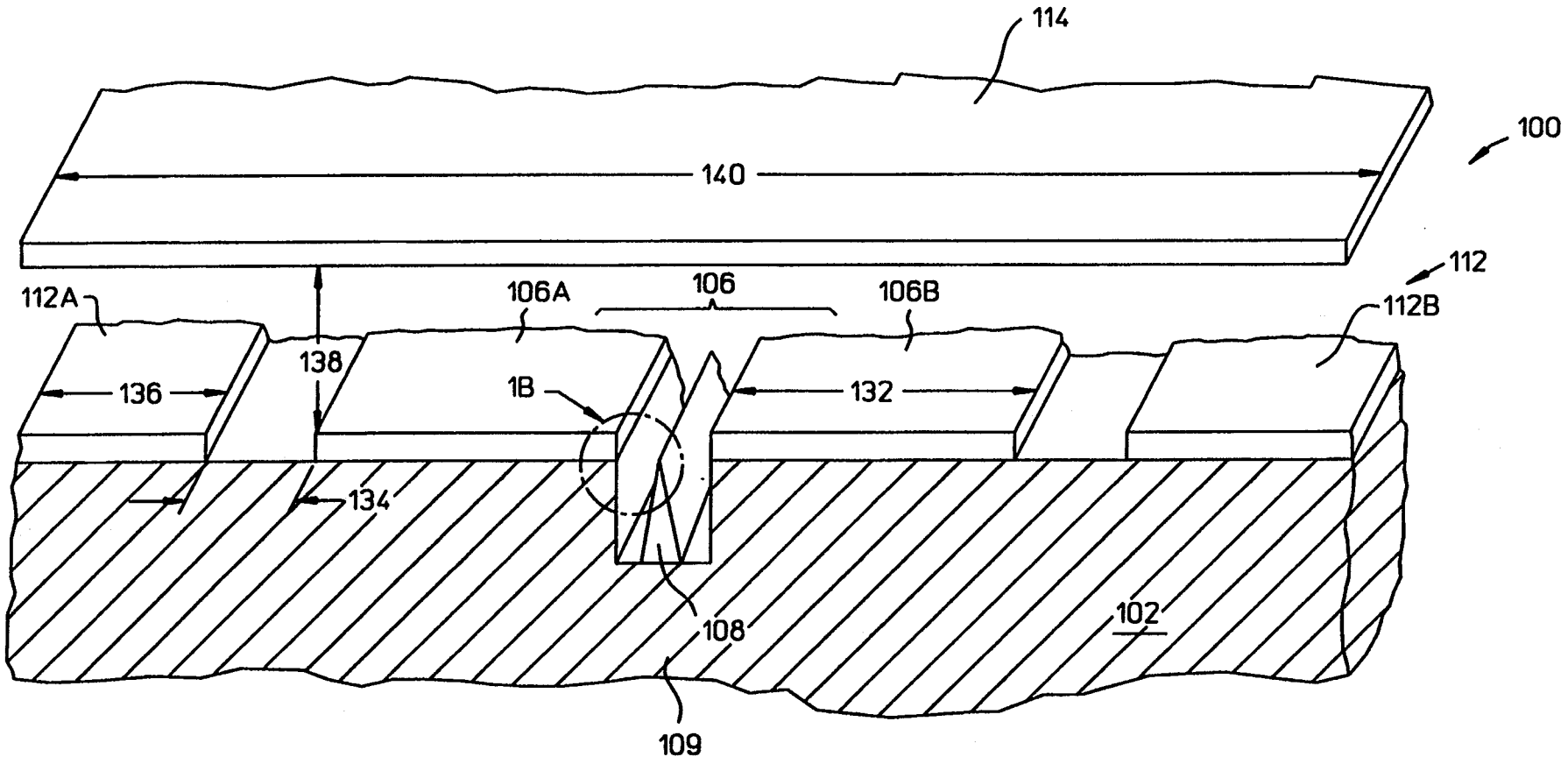
FIG. 1 shows a portion of a first preferred embodiment of the present invention.
Figure 1B:
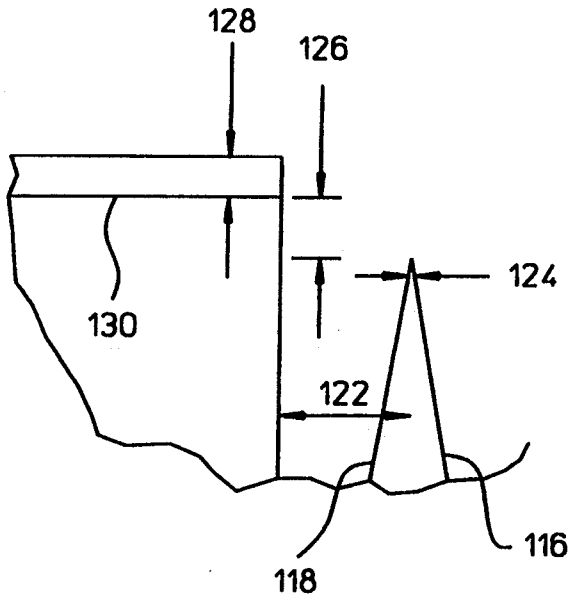

FIG. 1 shows a first preferred embodiment of the present invention. The field emission microelectronic device 100 includes an electron source 109, a collector 112 and an isolator 114. In one embodiment, the electron source 109 includes an electron emitter 108 and a gate 106, which is separated into a first gate 106A and a second gate 106B. The emitter 108, the gate 106 and the collector 112 are connected to a substrate 102. The emitter 108 is a non-insulating material; it can be a semiconductor. The gate 106, the collector 112 and the isolator 114 are preferably conductive, which can be polysilicon or metal.

The structure of the electron emitter 108 is similar to those in the area of field emitters. In the present embodiment, the structure resembles a line emitter. Other electron emitters, such as micro-thermionic sources, are also applicable. The type of field emitters similar to the first embodiment is shown, for example, in "Physical properties of thin-film field emission cathodes with molybdenum cones," by Spindt et al., published in the Journal of Applied Physics, Vol. 47, No. 12, December 1976, and in "Fabrication of Silicon Point, Wedge, and Trench FEAs," by Jones et al., published in the Technical Digest of Int. Vacuum Microelectronics Conf. 1991. Both references are hereby incorporated by reference. The emitter 108 has its tip having a tip width 124, which is separated from the first and the second gate by a tip lateral distance 122. The tip of the emitter is also offset from the surface 130 where the gate 106 is positioned by a tip upper distance 126. The gate 106 and the collector 112 have a similar thickness 128. The first and the second gate, each has a gate width 132. The collector 112 is again separated into two sides, the first collector 112A and the second collector 112B. The first collector 112A is positioned adjacent to and is separated from the first gate 106A by a gate-to-collector width 134, and similarly, the second collector 112B from the second gate 106B by a similar width 134. The first and the second collector, each has a collector width 136. In the first embodiment, the isolator, 114, is positioned above and substantially covers the emitter 108, the gate 106 and the collector 112. The isolator is positioned at an isolator height 138 from the gate 106, and has an isolator width 140. The isolator width 140 is preferably more than twice the isolator height 138. There may be additional structures, conducting or insulating, above the isolator, but the effect of the additional structures, which might be charged, on the first embodiment is substantially minimized due to the isolator creating an electrostatic enclosure. Thus, the preferred embodiment is substantially electrostatically shielded. Since the field emission microelectronic device and field emitters are based on electron emitters that can emit electrons out of the substrate, the microelectronic device and field emitters can be made from the same substrate and from substantially the same process. Thus, as the field emitters are fabricated, microelectronic devices to control the field emitters can be manufactured at the same time. There are different preferred methods to generate the isolator. One method is to position a piece of conducting material at the isolator height 138 from the emitter, the gate and the collector. Another method is to use a conducting wire mesh or a series of parallel conducting wires instead of the piece of conducting material. The spacing in the mesh or between the wires should preferably be less than the isolator height 138.

The emitter 108 is at an emitter voltage and the gate 106 at a gate voltage. With appropriate emitter and gate voltages, electrons are emitted from the emitter out of the substrate 102.

The collector 112 is at a collector voltage and the isolator is at an isolator voltage, which is preferably negative. With appropriate collector and isolator voltages, the electrostatic enclosure is created to substantially confine the electrons in the vicinity of the electron source and the collector. Moreover, with the appropriate voltages, the collector 112 receives a current, which is substantially proportional to the number of electrons emitted from the emitter 108, out of the substrate 102, into the collector 112 per unit time.

Figure 2:
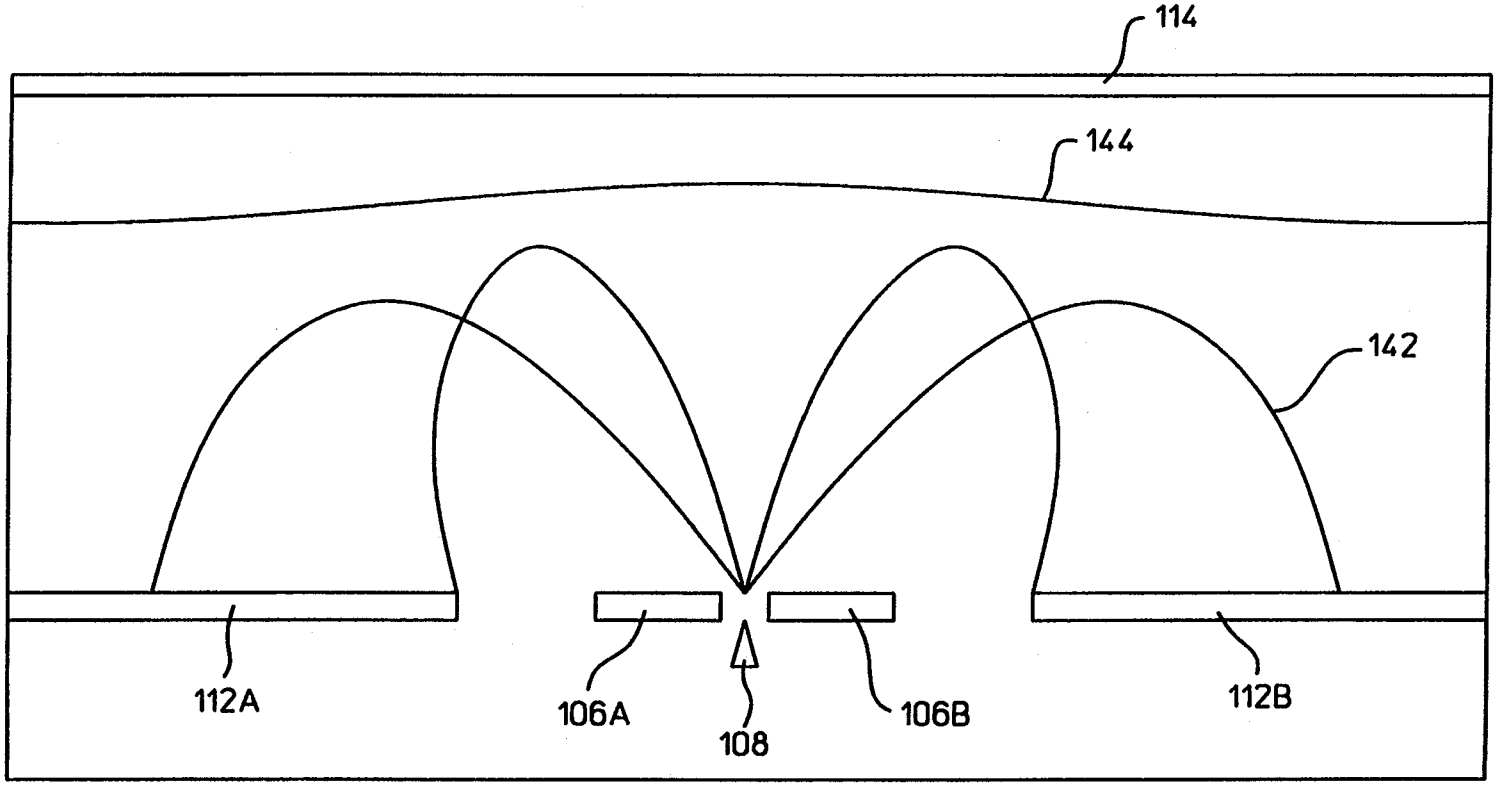
FIG. 2 shows an equi-potential surface and electron trajectories of the first preferred embodiment.
Figure 3:
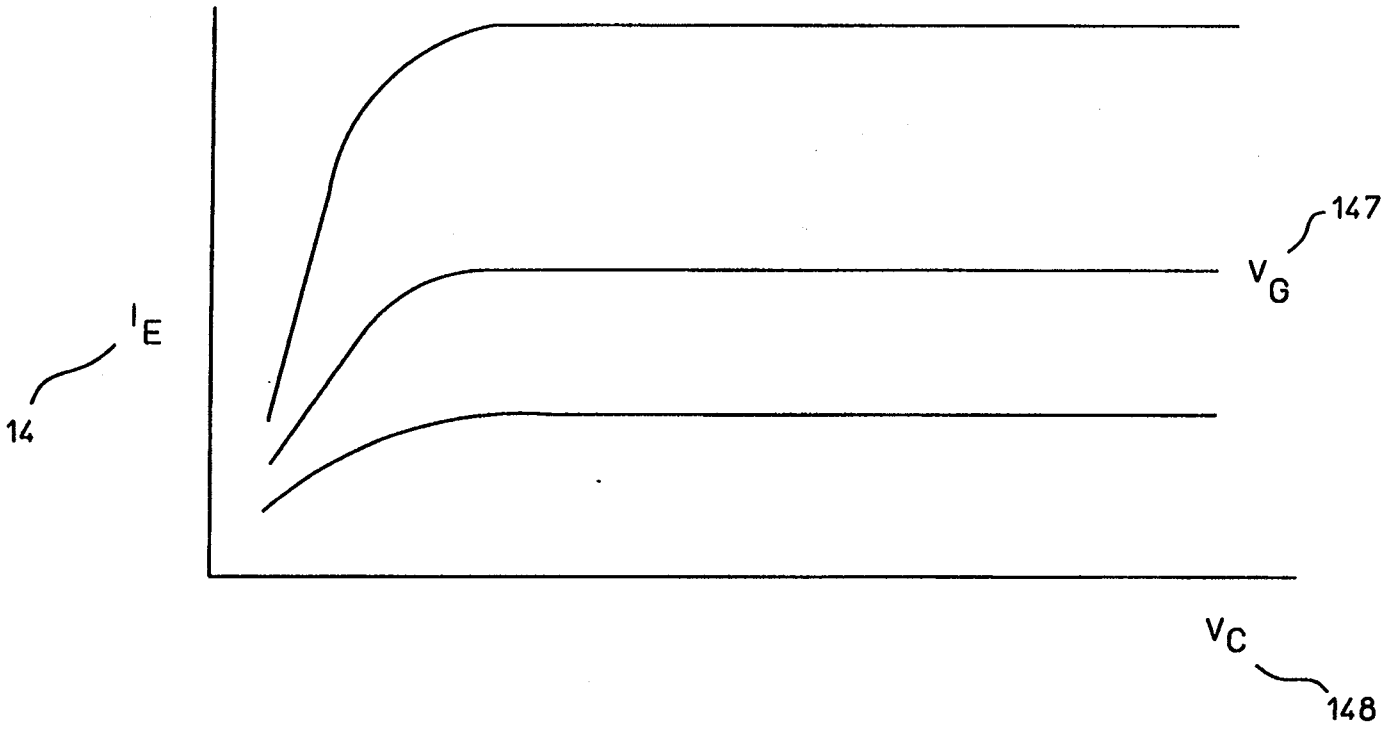
FIG. 3 illustrates a set of I-V curves of the present invention.

The current depends on the dimensions and the positions of and the voltages on the emitter 108, the first and the second gate, the first and the second collector, and the isolator 114. FIG. 2 graphically shows the electrostatic enclosure 144, which can be an equi-potential surface 144 with zero potential, and electron trajectories 142 from the emitter 108 to the collector 112. FIG. 3 shows a set of currents 146 generated by different collector voltages 148 and gate voltages 147. These curves are commonly known as transfer characteristics. With appropriate values, for a fixed collector voltage 148, as the gate voltage 147 changes, the current 146 changes dramatically, as in vacuum tubes. Thus the first embodiment is fabricated by methods substantially based on the fabrication methods of field emitters, but functions like a current controller. The dimensions, positions, voltages and currents of the first embodiment 100 are calculated by standard electron optics calculations and should be obvious to those with ordinary skill in the art. A general discussion on this type of calculations can be found in "Electron Beams, Lenses and Optics," written by El-Kareh and El-Kareh, and published by the Academic Press in 1970.

Figure 4:
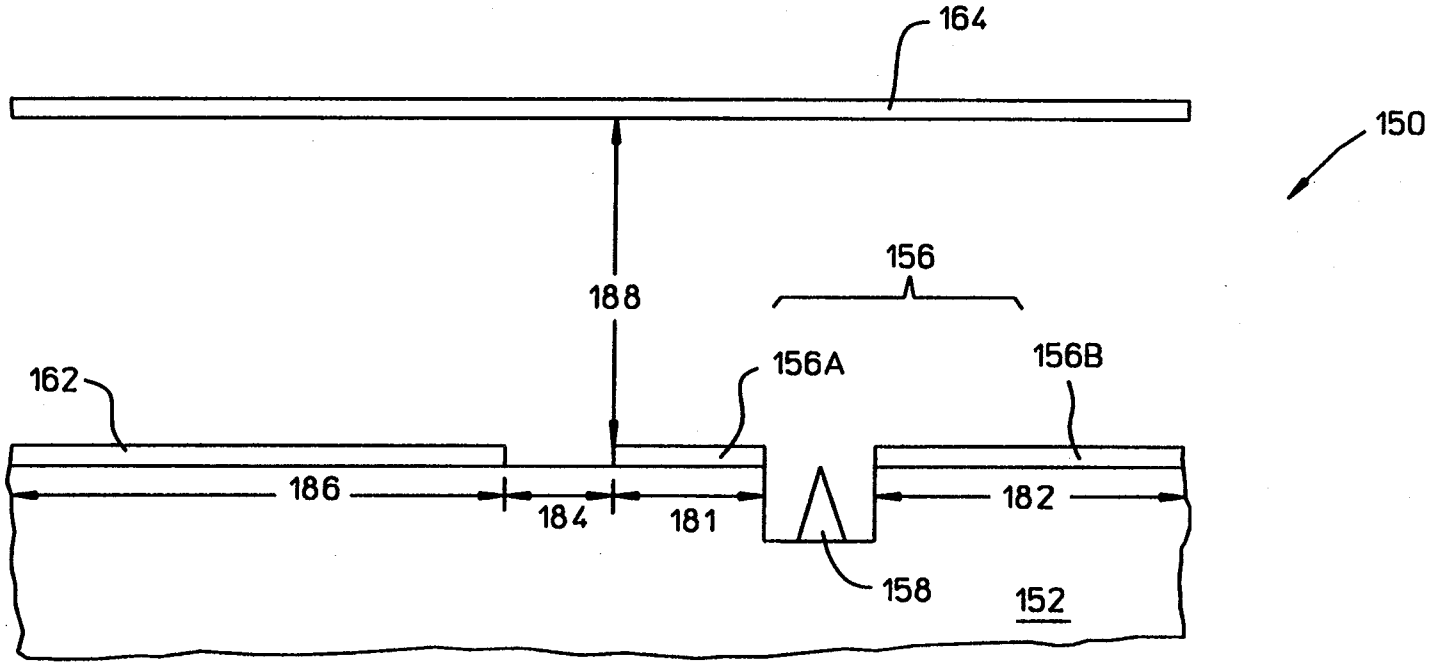
FIG. 4 shows a portion of a second preferred embodiment of the present invention.

FIG. 4 shows a portion of a second preferred embodiment 150 of the present invention. It is similar to the first embodiment except the first 156A and the second 156B gate preferably are of different dimensions and at different voltages, and the collector 162 is adjacent to the first gate 156A.

The second preferred embodiment 150 includes an emitter 158, a gate 156 separated into a first gate 156A and a second gate 156B, a collector 162, and an isolator 164. It is believed that the second preferred embodiment 150 has a higher current efficiency than the first preferred embodiment.

In the second embodiment, the first gate has the first gate width 181, and the second gate 156B a second gate width 182. The collector 162 has a collector width 186, and is separated from the first gate 156A by a gate-to-collector width 184. The isolator is separated and spaced from the gate 156 by an isolator height 188.

Figure 5:
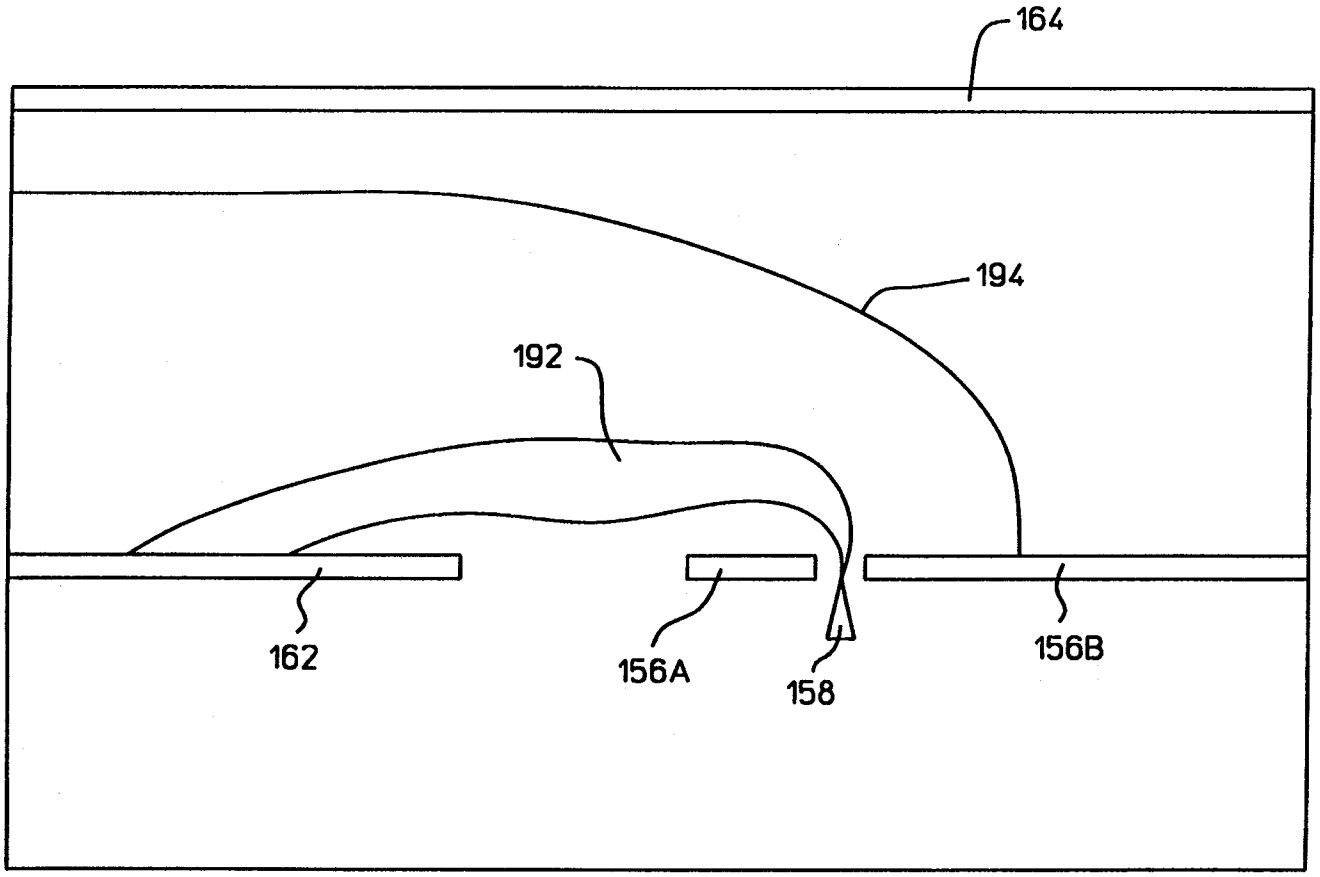
FIG. 5 shows an equi-potential surface and electron trajectories of the second preferred embodiment.
Figure 6:
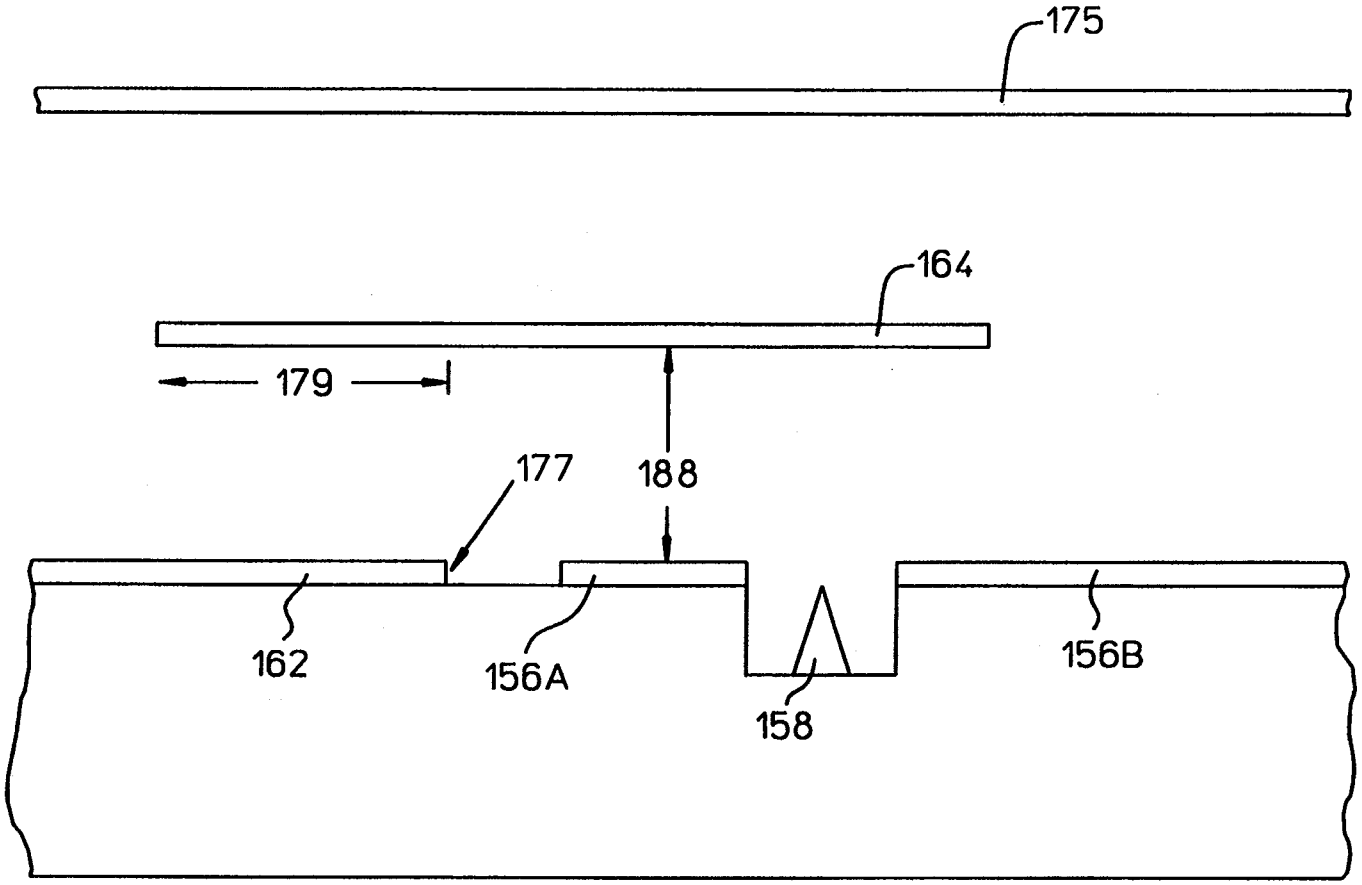
FIG. 6 shows an alternative configuration for the second embodiment.

FIG. 5 graphically shows an electrostatic enclosure, which in the present case is an equi-potential surface 194 at zero potential, and electron trajectories 192 from the emitter 158 to the collector 162. It is believed that due to the configuration in the second embodiment, fewer electrons are attracted to the gate than in the first embodiment; this might lead to a higher current efficiency in the second embodiment than in the first embodiment. FIG. 6 shows a different configuration for the second embodiment with a conductive material 175, which may be charged. In that configuration, the isolator 164 does not cover the second gate 156B; it extends beyond the edge 177 of the collector 162 by more than one isolator height 188. In other words, the distance of extension 179 is larger than the isolator height 188. With such a configuration and appropriate voltages on the isolators and the gates, the effects on the transfer characteristics by the additional conducting material over the microelectronic device are substantially minimized.

With appropriate values in the second configuration, for a fixed collector voltage, as the first gate voltage changes, the current changes dramatically. Thus the second embodiment is fabricated by methods substantially based on the fabrication methods of field emitters, but functions as a current controller.

Figure 7:
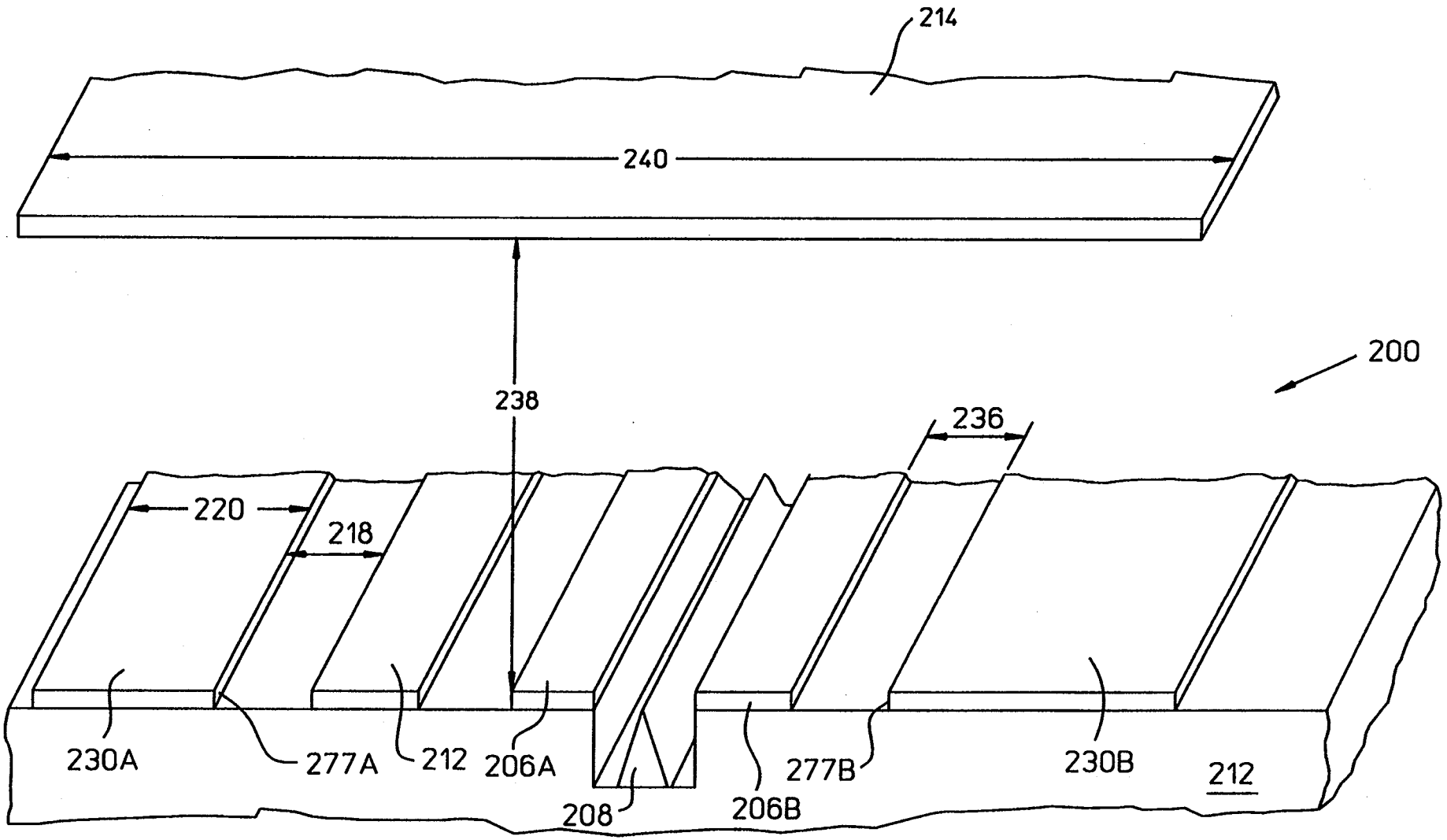
FIG. 7 shows a portion of a third preferred embodiment of the present invention with a screen.

FIG. 7 shows a portion of a third preferred embodiment 200 of the present invention. Its structure is similar to the first embodiment 100 except the isolator does not cover the substrate, but is separated into a first and a second isolators positioned on the substrate. Moreover, the collector 212 is adjacent to the first gate 206A, and the gates and the collector are confined by the first 230A and the second 230B isolator. Both the first and the second isolators are preferably conductive and can be made of polysilicon.

The first isolator 230A is separated from the collector 212 by a collector-to-isolator distance 218, and the second isolator 230B is separated from the second gate 206B by the collector-to-gate distance 236. The first isolator 230A and the second isolator 230B, each has a width 220. The first isolator 230A has a first isolator voltage and the second isolator 230B a second isolator voltage.

FIG. 7 further shows an additional piece of material 214 above the third embodiment 200. This piece of material may be conductive. It is believed that the voltages on the isolators create an electrostatic enclosure to substantially confine the emitted electrons in the vicinity of the electron source and the collector so that the effect of the sheet of material 214 on the electrons is substantially minimized.

The sheet of material 214 is separated from the gate 206 by a screen height 238, which may be orders of magnitude larger than the width of the collector.

Figure 8:
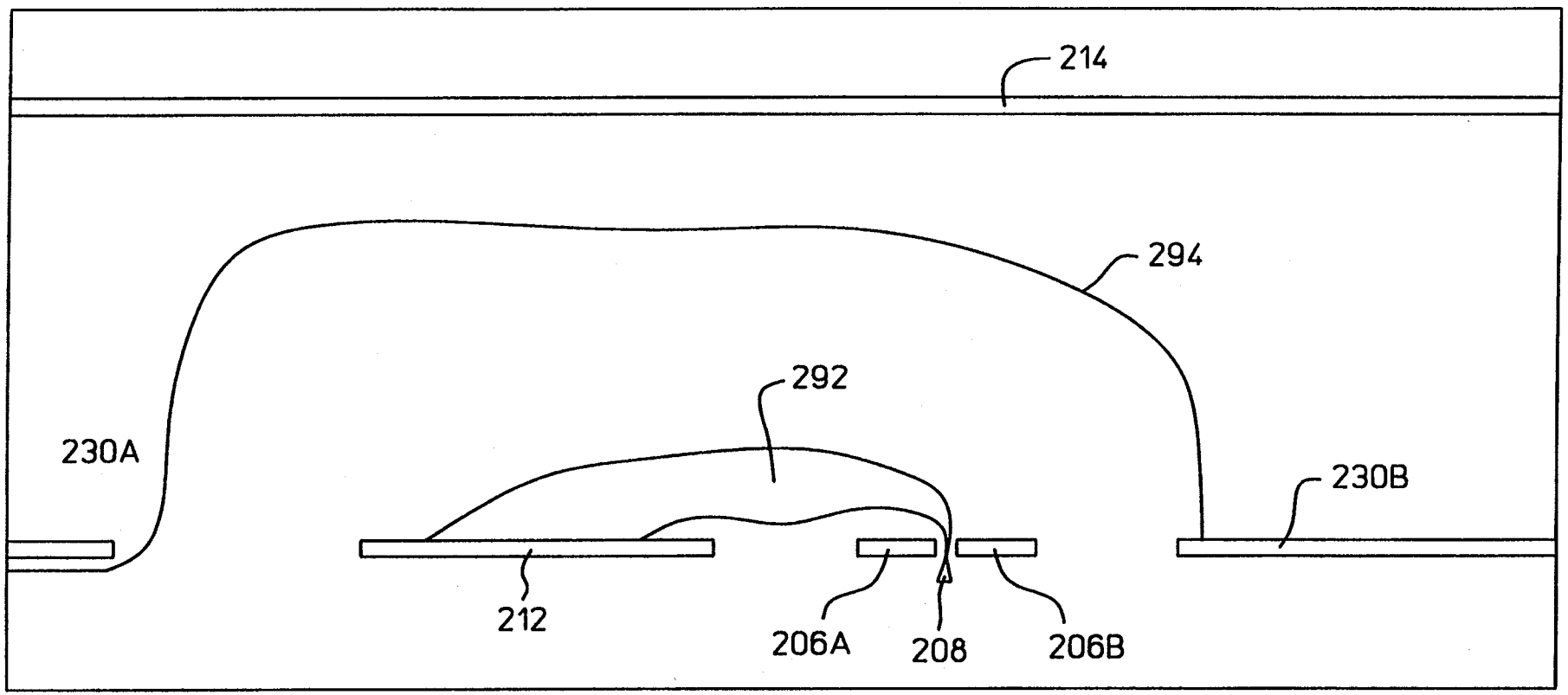
FIG. 8 shows an equi-potential surface and electron trajectories of the third preferred embodiment.

FIG. 8 graphically shows the electrostatic enclosure, which in the present case is an equi-potential surface 294 at zero potential, and electron trajectories 292 from the emitter 208 to the collector 212. The example shows that the effect of the sheet of material 214 is substantially minimized by the isolators. With appropriate values, for a fixed collector voltage, as the first gate voltage changes, the current changes dramatically as in a current controller.

The collector 212 in the third embodiment can be on both sides of the emitter 208 as in the first embodiment. If that is the case, the dimensions and the voltages on the third embodiment would be different, but the third embodiment, with a symmetrical collector, can again function as a current controller.

Figure 9:
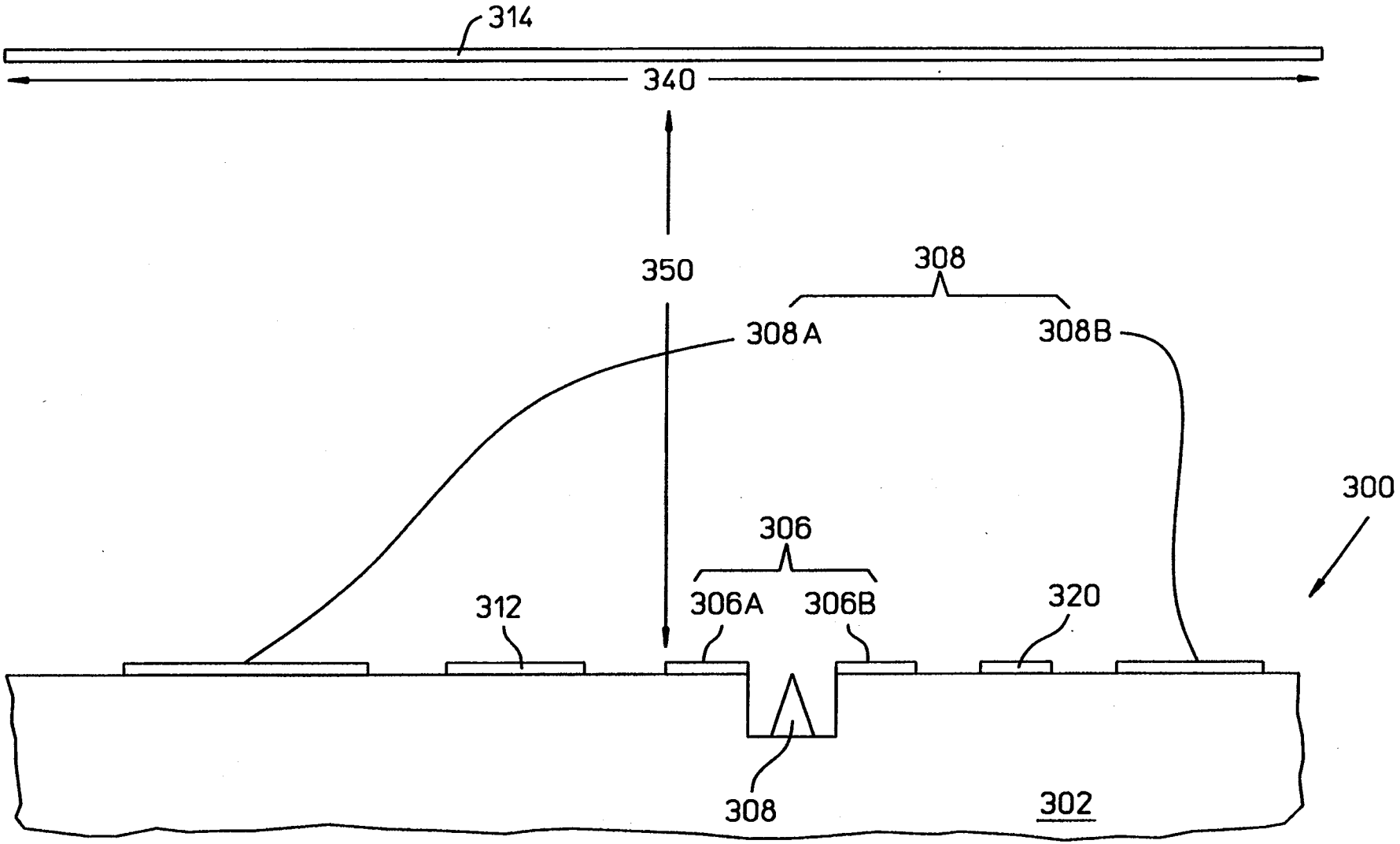
FIG. 9 shows a portion of a fourth preferred embodiment of the present invention with a screen.

FIG. 9 shows the fourth embodiment 300 and a sheet of material 314. The fourth embodiment 300 is similar to the third embodiment except that there is an additional guard 320 between the second gate 306B and the second isolator 308B. The guard is preferably conductive and can be made of polysilicon. The guard 320 has a guard width 386, is separated from the second gate 306B by a gate-to-guard distance 384, and is separated from the second isolator 308B by a guard-to-isolator distance 388. The guard 320 has a guard voltage. It is believed that this guard 320 further guides the emitted electrons from the emitter 308 to the collector 312, and its presence is especially beneficial when the voltage on the sheet of material is positive, as the voltage on the screen of a flat panel display.

Figure 10:
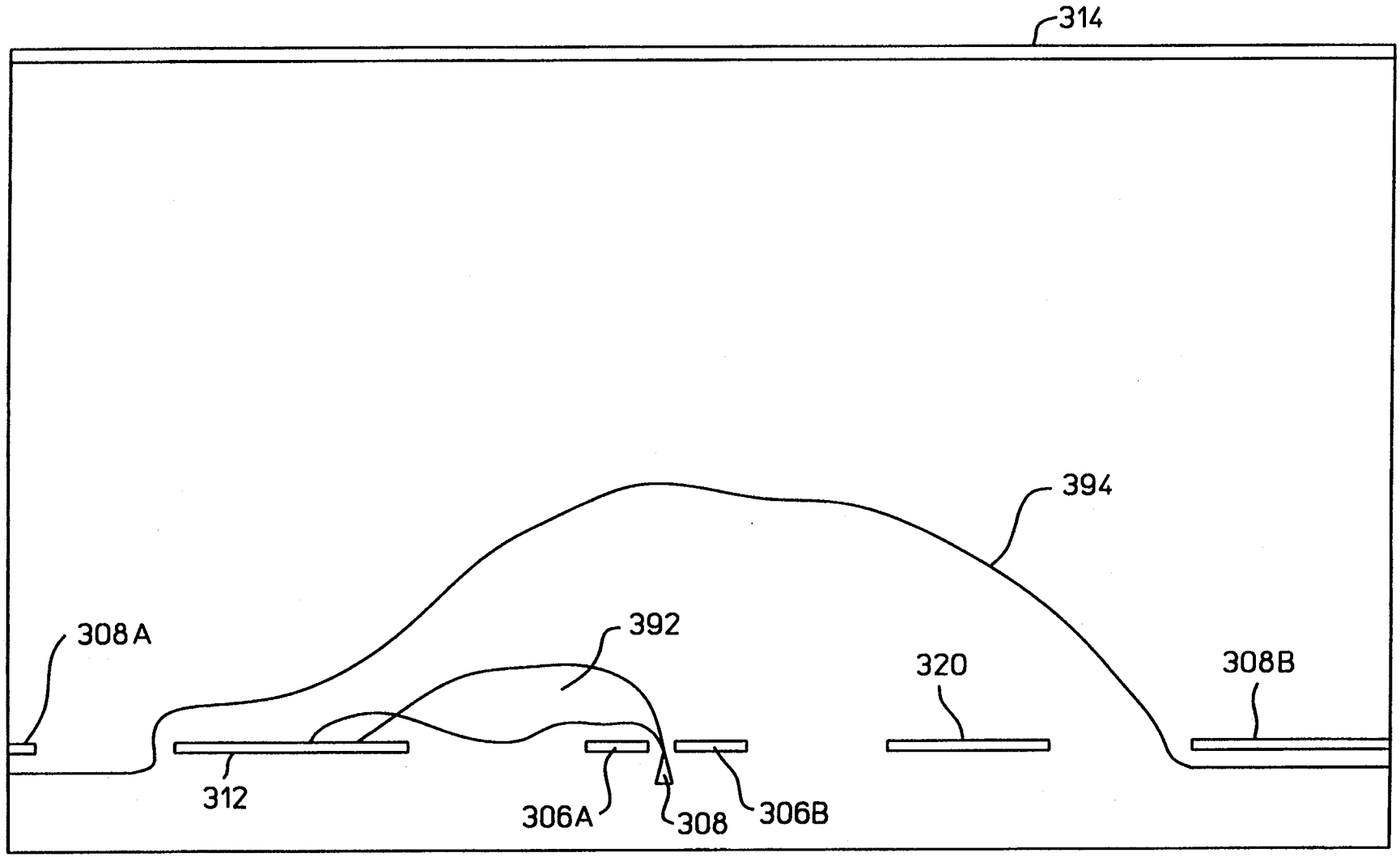
FIG. 10 shows an equi-potential surface and electron trajectories of the fourth preferred embodiment.

FIG. 10 graphically shows an electrostatic enclosure, which in the present case is an equi-potential surface 394 at zero potential, and electron trajectories 392 from the emitter 308 to the collector 312. The example again shows the isolators and the guard minimizing the effect of the voltage on the sheet of material 314. With appropriate values, for a fixed collector voltage, as the first gate voltage changes, the current changes dramatically as in a current controller.

The collector 312 and the guard 320 in the fourth embodiment can be on both sides of the emitter 308. If that is the case, the dimensions and the voltages on the fourth embodiment would be different, but the fourth embodiment, with a symmetrical collector and a symmetrical guard, can again function as a current controller.

Working Embodiment

The invention will be further clarified by a consideration of the following examples, which are intended to be purely exemplary of the use of the invention.

In one example for the first embodiment as shown in FIG. 1, the substrate 102 is made of glass or oxidized silicon or other types of material with an insulating surface at least about 1 micron thick. The emitter has a tip width 124 of tens of angstroms, a tip lateral distance 122 of about 0.2 microns and a tip upper distance 126 of about 0.1 microns. The thickness 128 of the collector is about 0.1 microns. The gate width 132 of the first and the second gate is about 2 microns, the gate-to-collector width 134 is about 3 microns, and the collector width 136 is about 10 microns. The isolator 114 has an isolator width 140 of about 30 microns and an isolator height 138 of about 10 microns.

In the specific example shown in FIG. 2, the voltage on the emitter 108 is preferably at 0 volt, the voltage on the gate 106 preferably ranges from 0 to 100 volts and is preferably at 40 volts, the voltage on the isolator 114 is preferably −10 volts, the voltage on the collector 112 is 10 volts, and the equi-potential surface 144 is at 0 volt. The current changes as the collector voltage changes and as the gate voltage changes. In one example for the second embodiment, all the dimensions are similar to the example of the first embodiment except the second gate 156B has a width of about 10 microns. In the specific example shown in FIG. 5, the emitter and the second gate are at 0 volts, the first gate and the collector at 40 volts, the isolator at −10 volts, and the equi-potential surface 194 at 0 volts.

In one example for the third embodiment, all the dimensions are similar to the example of the first embodiment except the width of the first and the second isolator 220 is about 10 microns, the collector-to-isolator width 218 is about 5 microns, and the gate-to-isolator width 236 is about 3 microns. In the specific example shown in FIG. 8, the emitter 208, the second gate 206B and the second isolator 230B are at 0 volts, the first gate 206A at 40 volts, the collector at 20 volts, the first isolator 230A at −10 volts, and the equi-potential surface 294 at 0 volts. Note that the sheet of material 214 is assumed to be at −10 volts and is about 10 microns from the substrate 212.

In one example for the fourth embodiment, all the dimensions are similar to the example of the third embodiment except the guard width 386 is about 5 microns, the gate-to-guard distance 384 is about 3 microns and the guard-to-isolator distance 388 is about 5 microns. In this example, the sheet height 350 is about 2 millimeters, and the sheet width 340 is more than 4 millimeters. In the specific example shown in FIG. 10, the emitter 308 and the second gate 306B are at 0 volts, the first gate 306A and the guard 320 are at 50 volts, the collector 312 is at 10 volts and the first 308A and the second 308B isolator are at −350 volts. The sheet of material is at 6500 volts as in the voltage of the screen of a flat panel display. The equi-potential surface 394 is at 0 volts. In this example, although the sheet of material is at 6500 volts, the emitted electrons are substantially confined by the electrostatic enclosure 394 from reaching the sheet of material 314.

The above calculated values in the working embodiments are based on standard electron optics calculations and should be obvious to those with ordinary skill in the art.

From the foregoing it should be appreciated that a new microelectronic device has been invented. This new microelectronic device is based on similar manufacturing processes as field emitters. The new microelectronic device can be applied to numerous areas, such as flat panel displays. Though the present invention only describe one type of field emitters as the electron source, other types of electron sources are perfectly applicable. Moreover, the present invention only describes a certain number of electrodes, such as gates, collector, isolators and guard, more electrodes can be used to further guide the electrons from their emitter to their collector. Though the electrodes on the substrate are all described to be on the same plane, the invention is applicable to electrodes on planes having different height. It also should be obvious to those in the art that the present invention can be used in place of a vacuum tube or a transistor or a diode.

Other embodiments of the invention will be apparent to the skilled in the art from a consideration of this specification or practice of the invention disclosed herein. It is intended that the specification and examples be considered as exemplary only, with the true scope and spirit of the invention being indicated by the following claims.

I claim:

1. An apparatus comprising:

an electron source coupled to a substrate, with at least one voltage controlling the emission of electrons from the source out of the substrate;

a collector coupled to the substrate and positioned adjacent to the electron source, the collector being at a collector voltage to receive a current, which is substantially proportional to the number of electrons emitted from the source into the collector per unit time; and an isolator at an isolator voltage located proximate to the emitter source to create an electrostatic enclosure for minimizing the effect of external charged structures on the electrons emitted from the source to the collector.

2. An apparatus as recited in claim 1 wherein the isolator substantially covers and is spaced from the source and the collector.

3. An apparatus as recited in claim 2 wherein the electron source comprises:

an electron emitter coupled to the substrate, the emitter being at an emitter voltage, and having a first side and a second side;

a first gate coupled to the substrate and positioned adjacent to the first side of the emitter, the first gate being at a first gate voltage; and a second gate coupled to the substrate and positioned adjacent to the second side of the emitter, the second gate being at a second gate voltage;

such that the emitter, the first and the second gate voltage control the emission of the electrons emitted from the emitter.

4. An apparatus as recited in claim 3 wherein the collector is positioned adjacent to the first gate.

5. An apparatus as recited in claim 3 wherein the collector has two sub-collectors, the first sub-collector is positioned adjacent to the first gate and the second sub-collector is positioned adjacent to the second gate.

6. An apparatus as recited in claim 1 wherein the isolator is separated into a first isolator and a second isolator, one on each side of both the source and the collector, both isolators being coupled to the substrate, the first isolator having the first isolator voltage and the second isolator having the second isolator voltage.

7. An apparatus as recited in claim 6 wherein the electron source comprises:

an electron emitter coupled to the substrate, the emitter being at an emitter voltage, and having a first side and a second side;

a first gate coupled to the substrate and positioned adjacent to the first side of the emitter, the first gate being at a first gate voltage; and a second gate coupled to the substrate and positioned adjacent to the second side of the emitter, the second gate being at a second gate voltage;

such that the emitter, the first and the second gate voltage control the emission of the electrons emitted from the emitter.

8. An apparatus as recited in claim 7 wherein the collector is positioned adjacent to the first gate.

9. An apparatus as recited in claim 8 further comprising a guard coupled to the substrate and positioned between the second isolator and the second gate, the guard being at a guard voltage to further guide the emitted electrons from the emitter to the collector.

10. A method comprising the steps of:

applying at least one voltage to an electron source which is coupled to a substrate, the applied voltage controlling the emission of electrons from the electron source out of the substrate;

applying a collector voltage to a collector, which is coupled to the substrate and positioned adjacent to the electron source such that the collector receives a current, which is substantially proportional to the number of electrons emitted from the electron source into the collector per unit time; and applying an isolator voltage to an isolator located proximate to an emitter source to create an electrostatic enclosure for minimizing the effect of external charged structures on the electrons emitted from the source to the collector.

11. A method as recited in claim 10 wherein the isolator substantially covers and is spaced from the source and the collector.

12. A method as recited in claim 11 wherein the step of applying at least one voltage to an electron source further comprises the steps of:

applying an emitter voltage to an electron emitter, which is coupled to the substrate, the electron emitter having a first and a second side;

applying a first gate voltage to a first gate, which is coupled to the substrate, and positioned adjacent to the first side of the emitter; and applying a second gate voltage to a second gate, which is coupled to the substrate, and positioned adjacent to the second side of the emitter;

such that the emitter, the first and the second gate voltages control the emission of electrons from the emitter.

13. A method as recited in claim 12 wherein the collector is positioned adjacent to the first gate.

14. A method as recited in claim 12 wherein the collector has two sub-collectors, the first sub-collector is positioned adjacent to the first gate and the second sub-collector is positioned adjacent to the second gate.

15. A method as recited in claim 10 wherein the step of applying an isolator voltage to an isolator further comprises the steps of:

applying a first isolator voltage to a first isolator; and applying a second isolator voltage to a second isolator;

such that the first isolator and a second isolator are positioned with one on each side of both the source and the collector, both isolators being coupled to the substrate.

16. A method as recited in claim 15 wherein the step of applying at least one voltage to an electron source further comprises the steps of:

applying an emitter voltage to an electron emitter, which is coupled to the substrate, the electron emitter having a first and a second side;

applying a first gate voltage to a first gate, which is coupled to the substrate, and positioned adjacent to the first side of the emitter; and applying a second gate voltage to a second gate, which is coupled to the substrate, and positioned adjacent to the second side of the emitter;

such that the emitter, the first and the second gate voltages control the emission of electrons from the emitter.

17. A method as recited in claim 16 wherein the collector is positioned adjacent to the first gate.

18. A method as recited in claim 17 further comprises the step of applying a guard voltage to a guard to further guide the emitted electrons from the emitter to the collector, the guard being coupled to the substrate and positioned between the second isolator and the second gate.

19. A flat panel display system comprising:

field emitters; and an apparatus for driving the field emitters, the apparatus comprising:

an electron source coupled to a substrate, with at least one voltage controlling the emission of electrons from the source, out of the substrate;

a collector coupled to the substrate and positioned adjacent to the electron source, the collector being at a collector voltage to receive a current, which is substantially proportional to the number of electrons emitted from the source into the collector per unit time; and an isolator at an isolator voltage located proximate to the emitter source to create an electrostatic enclosure for minimizing the effect of external charged structures on the electrons emitted from the source to the collector;

wherein:

the isolator substantially covers and is spaced from the source and the collector;

the electron source comprises:

an electron emitter coupled to the substrate, the emitter being at an emitter voltage, and having a first side and a second side;

a first gate coupled to the substrate and positioned adjacent to the first side of the emitter, the first gate being at a first gate voltage; and a second gate coupled to the substrate and positioned adjacent to the second side of the emitter, the second gate being at a second gate voltage;

such that the emitter, the first and the second gate voltage control the emission of the electrons emitted from the emitter; and the collector is positioned adjacent to the first gate.

* * * * *